US005517702A

United States Patent [19]

Fraher

[11] Patent Number: 5,517,702

[45] Date of Patent: May 21, 1996

[54] INTERNAL POOL COVER SUPPORT

[76] Inventor: James R. Fraher, 14721 Long Ave., Oak Forest, Ill. 60452

[21] Appl. No.: 245,819

[22] Filed: May 18, 1994

Related U.S. Application Data

[63] Continuation of Ser. No. 930,267, Aug. 17, 1992, abandoned.

[51] Int. Cl.[6] ..... E04H 4/10

[52] U.S. Cl. ..... 4/498; 248/161; 248/910

[58] Field of Search ..... 4/494, 496, 498, 4/503, 546, 548, 551, 573.1, 578.1, 579, 580; 108/150; 248/159, 161, 354.5, 910; 52/222

[56] References Cited

U.S. PATENT DOCUMENTS

| | | | |
|---|---|---|---|
| 135,435 | 2/1873 | Lyon | 248/161 |
| 352,608 | 11/1886 | Cole | 248/159 |
| 1,746,487 | 2/1930 | Martin | 248/159 X |
| 1,877,098 | 9/1932 | Washburn | 248/910 X |
| 2,720,249 | 10/1955 | Peterson | 108/150 X |
| 3,017,183 | 1/1962 | Chalcroft | 248/161 X |
| 3,119,588 | 1/1964 | Keats | 248/910 X |
| 3,521,416 | 7/1970 | Joor, II | 52/222 |
| 3,863,874 | 2/1975 | Pirovano | 248/910 X |
| 4,591,126 | 5/1986 | Berney | 248/910 X |
| 4,776,046 | 10/1988 | Newberry et al. | 4/546 |
| 4,951,327 | 8/1990 | Del Gorio, Sr. | 4/498 |
| 5,259,077 | 11/1993 | Hager et al. | 4/498 |

FOREIGN PATENT DOCUMENTS

| | | | |
|---|---|---|---|
| 0498156 | 1/1939 | United Kingdom | 4/578.1 |
| 0608370 | 9/1948 | United Kingdom | 248/161 |

*Primary Examiner*—Robert M. Fetsuga
*Attorney, Agent, or Firm*—Patula & Associates

[57] ABSTRACT

A pool cover support consisting of a base, vertical member and support member. The base has a bottom, with vertical dividers rising perpendicularly therefrom. The vertical dividers form a plurality of cavities in which weights are placed to anchor the base to the pool floor. The base also has a vertical tube which is slightly larger than the vertical member disposed therein. Atop the vertical member is disposed the support member, which supports the pool cover above the water level of the pool. The height of the pool cover support can be adjusted either at the base or the support member, so that the invention may be used in a variety of swimming pools or tubs having different depths.

2 Claims, 3 Drawing Sheets

INTERNAL POOL COVER SUPPORT

This application is a continuation of parent application Ser. No. 07/930,267, filed Aug. 17, 1992, and now abandoned.

FIELD OF THE INVENTION

This invention teaches a novel method of supporting a swimming pool or tub cover.

BACKGROUND OF THE INVENTION

It is typical to cover a swimming pool or tub with a cover when same is not in use, to prevent the water from becoming contaminated with debris from the environment. If the water of the pool or tub is chemically treated, for example with chlorine, then the cover may retard evaporation of the chemicals.

However, most pool or tub covers sag under their own weight, and float on top of the pool or tub water. The result is that the cover actually becomes a dish, which can collect leaves, sticks, rain, etc. The cover's shape makes it difficult to clean without going through the arduous task of completely removing the cover, and it is rare that the cover can be removed without some of the debris falling into the pool or tub even when the utmost care is exercised. Other types of pool supports that float freely atop the water can create tension on the pool cover as the floating support moves across the surface of the water. This often can cause the pool cover support to detach or rip. The present invention solves these problems by teaching a simple, easy to install or remove, pool cover support which can be used by any member of the family. The invention's simple yet functional design is further easy and inexpensive to manufacture.

Several other tarp type supports are known in the prior art, but are distinguishable from the present invention. For example, U.S. Pat. No. 4,847,925 to Perry and U.S. Pat. No. 3,769,639 to Bishop disclose pool cover supports, but float on top of the water, whereas the present invention is anchored at the bottom of the pool. U.S. Pat. No. 4,951,327 to Del Gorio, Sr. and U.S. Pat. No. 3,161,990 to Morris, disclose telescopic supports, but rely on spring tension within the support itself to maintain the cover's position, whereas the present invention relies on a weighted base to maintain the pool cover's position. Finally, U.S. Pat. No. 1,669,611 to Goldberg and U.S. Pat. No. 138,774 to Whitcomb also disclose supports, but are permanently anchored into the ground, whereas the present invention may be simply and easily removed from the bottom of the pool or tub.

BRIEF SUMMARY OF THE INVENTION

The preferred embodiment of the invention consists of base, vertical member and support member. The base has a bottom, with vertical dividers rising perpendicularly therefrom. The vertical dividers form a plurality of cavities in which weights are placed to anchor the base to the pool floor. The base also has a vertical tube which is slightly larger than the vertical member disposed therein. Atop the vertical member is disposed the support member, which supports the pool cover above the water level of the pool or tub sides. Debris from the environment can thereafter roll toward the side of the pool or tub when it falls thereon. In the preferred embodiment of the invention, the height of the invention can be adjusted either at the base or the support member, so that the invention may be used in a variety of swimming pools or tubs having different depths.

It is the principle object of the present invention to teach a device for supporting the pool cover of a swimming pool.

It is another object of the invention to provide an easily removable and installable device for supporting the cover of a swimming pool.

It is further an object of the invention to teach a swimming pool cover support stand that can be removed or installed by persons of limited strength.

An additional object of the invention is to teach a device that can keep the top of a swimming pool cover free of debris.

Also, an object of the invention is to provide a pool cover support stand that is collapsible for easy storage.

It is moreover an object of the invention to teach a pool cover support that can be adjusted to fit any kind of swimming pool.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DESCRIPTION OF THE EMBODIMENTS OF THE PRESENT INVENTION

Figure 1:
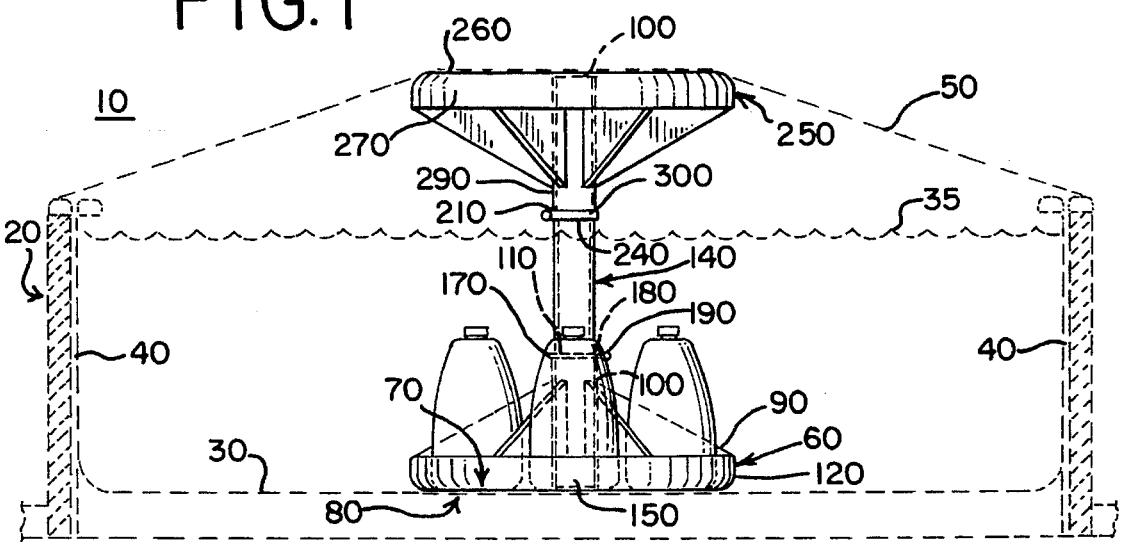
FIG. 1 is a front view of the preferred embodiment of the invention in the environment of a swimming pool.

While the invention is susceptible of embodiment in many different forms there is shown in the drawings and will be described herein in detail, preferred and alternate embodiments of the invention. It should be understood, however, that the present disclosure is to be considered an exemplification of the principles of the invention and is not intended to limit the spirit and scope of the invention and/or claims of the embodiments illustrated.

Referring now to the drawings, FIG. 1 shows a side elevational view of the preferred embodiment of the invention 10, in pool 20. Pool 20 has pool floor 30, water 35 and pool wall 40. Invention 10 supports pool cover 50. The invention 10 has base 60, vertical member 140, and support member 250. Base 60 has base top 70, base bottom 80, vertical dividers 90, vertical tube 100, vertical tube edge 110 and base rim 120. Base 60 is likely to be made of plastic, but could be constructed of any other material as well, including metal, or rubber.

Vertical member 140 has first end 150 and second end 160. Vertical member 140 is of a diameter to fit within vertical tube 100. Vertical member 140 may, but need not, have a first adjustment assembly 170 disposed on first end 150. First adjustment assembly 170 may consist of first set of horizontal bores 180, and first pin 190. First adjustment assembly 170 could alternatively consist of a first clamp (not shown). Vertical member 140 may also, but need not have second adjustment assembly 210 disposed on second end 160 of vertical member 140. Second adjustment assembly 210 may consist of second set of horizontal bores 220 (see FIG. 3), and second pin 230 (see FIG. 3). Alternatively, second adjustment assembly 210 could consist of second clamp 240. Vertical member 140 may be constructed of metal or plastic, or any other suitable material such as hard rubber, and vertical member 140 may be either a hollow or solid tube.

Support member 250 has support top 260, support bottom 270, vertical supports 280, and support tube 290, support tube 290 having support tube edge 300. Support tube 290 is of a diameter larger than vertical member 140, and second end 160 of vertical member 140 is inserted into support tube 290. In the preferred embodiment, support member 250 is constructed of plastic, but could conceivably be constructed of any other type of material such as metal or hard rubber.

Figure 2:
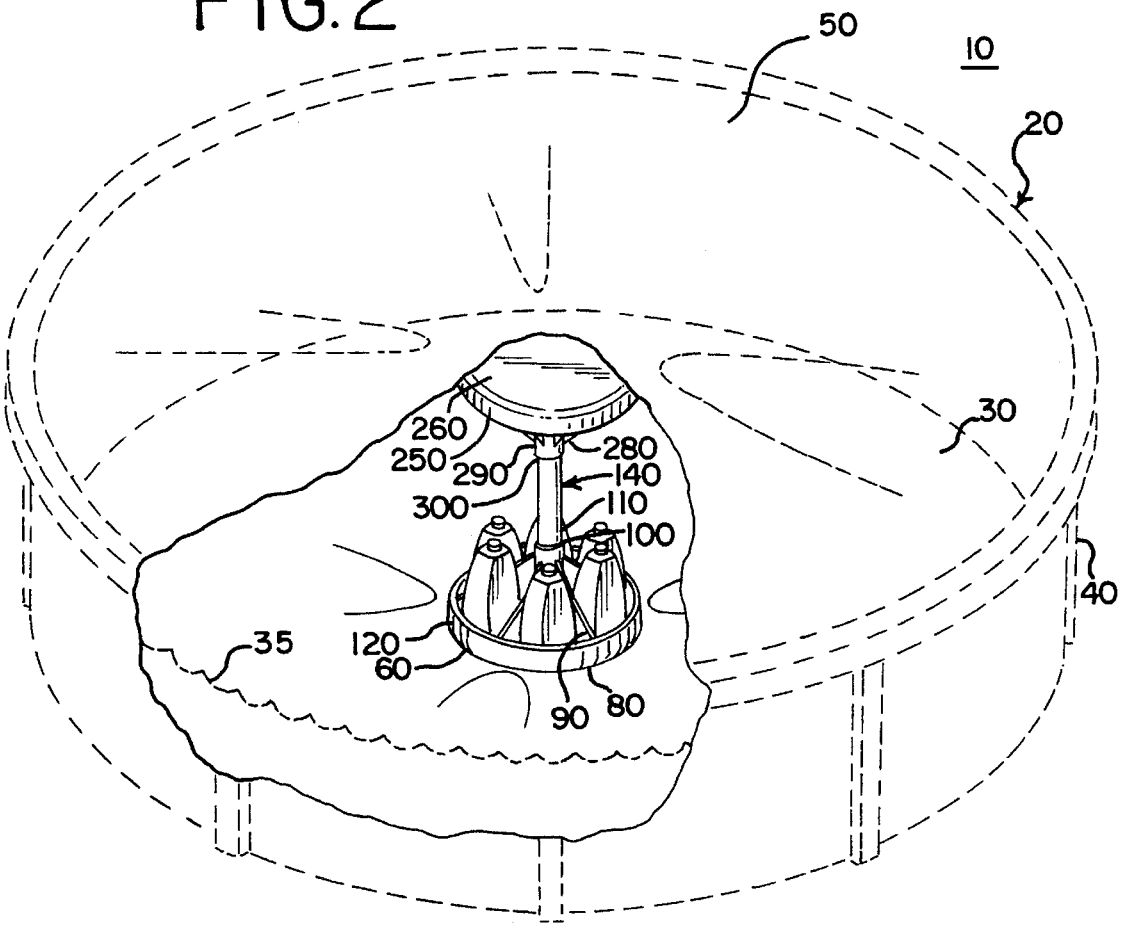
FIG. 2 is a perspective view of the preferred embodiment of the invention of FIG. 1 in the environment of a swimming pool.

FIG. 2 shows a side elevational view of the preferred embodiment of the invention 10, in pool 20. Pool 20 has pool floor 30, water 35 and pool wall 40. Invention 10 supports pool cover 50. The invention 10 has base 60, vertical member 140, and support member 250. Base 60 has base bottom 80, vertical dividers 90, vertical tube 100, vertical tube edge 110 and base rim 120.

Vertical member 140 is of a diameter to fit within vertical tube 100. Vertical member 140 may, but need not, have a first adjustment assembly 170 disposed on first end 150. Support member 250 has support top 260, vertical supports 280, and support tube 290, support tube 290 having support tube edge 300. Support tube 290 is of a diameter larger than vertical member 140, and second end 160 of vertical member 140 is inserted into support tube 290.

Figure 3:
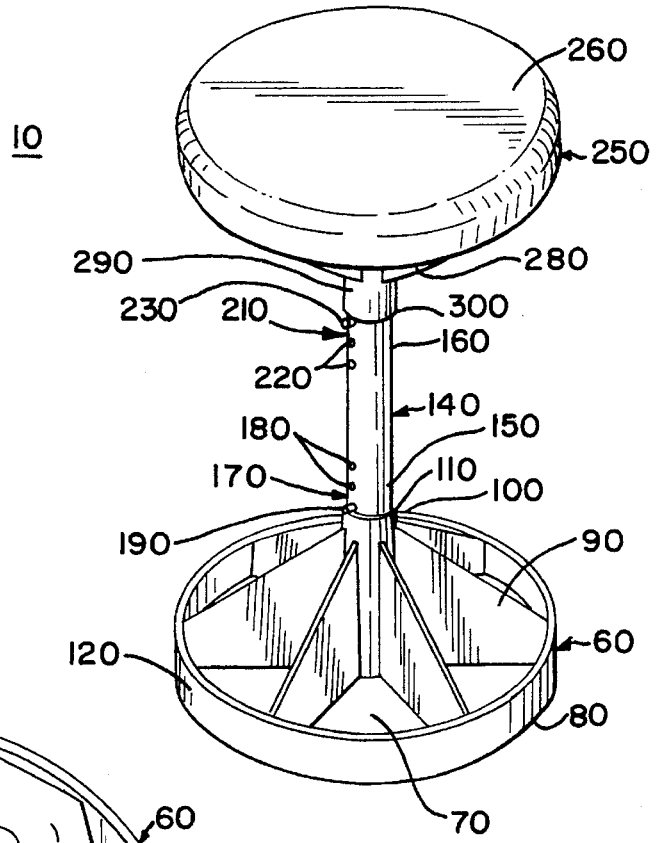
FIG. 3 is a perspective view of the preferred embodiment of the invention of FIG. 1.

FIG. 3 shows a perspective view of the preferred embodiment of the invention 10. The invention 10 has base 60, vertical member 140, and support member 250. Base 60 has base top 70, base bottom 80, vertical dividers 90, vertical tube 100, vertical tube edge 110 and base rim 120.

Vertical member 140 has first end 150 and second end 160. Vertical member 140 is of a diameter to fit within vertical tube 100. Vertical member 140 has a first adjustment assembly 170 disposed on first end 150. First adjustment assembly 170 has first set of horizontal bores 180, and first pin 190. Vertical member 140 also has second adjustment assembly 210 disposed on second end 160 of vertical member 140. Second adjustment assembly 210 has second set of horizontal bores 220, and second pin 230.

Support member 250 has support top 260, support bottom 270, vertical supports 280, and support tube 290, support tube 290 having support tube edge 300. Support tube 290 is of a diameter larger than vertical member 140, and second end 160 of vertical member 140 is inserted into support tube 290. As is clearly shown in the drawings of FIGS. 1–3, support member 250 is identical in configuration and construction to base 60 and therefore could be readily interchanged.

Figure 4:
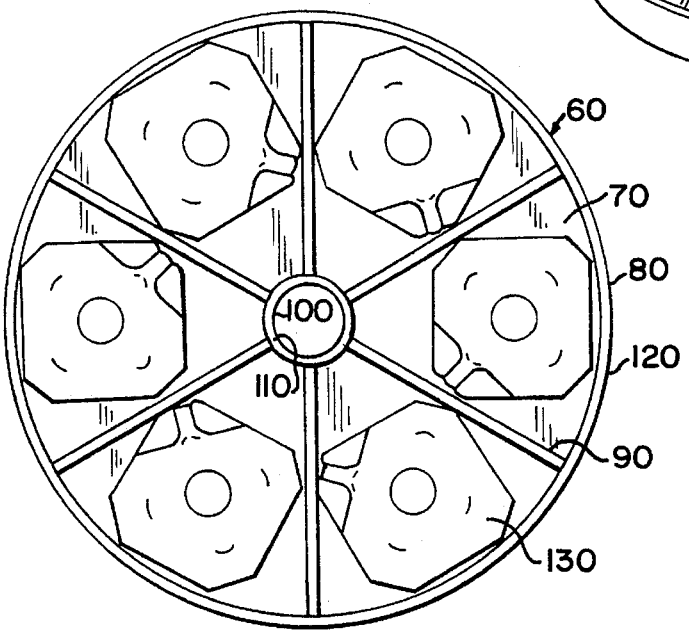
FIG. 4 is a top plan cross-sectional view showing the base of the preferred embodiment of the invention of FIG. 1.

FIG. 4 is a top plan view of the base 60 (or identical support member 250) of the preferred embodiment of the invention 10. Base 60 has base top 70, base bottom 80, vertical dividers 90, vertical tube 100, vertical tube 100 having vertical tube edge 110. Base 60 also has base rim 120, and bulk weight 130. The bulk weight 130 shown are ordinary milk cartons having handles (as illustrated) and being filled with sand, but could be any other type of large weight which is heavier than water, such as rocks, metal pieces, etc.

Figure 5:
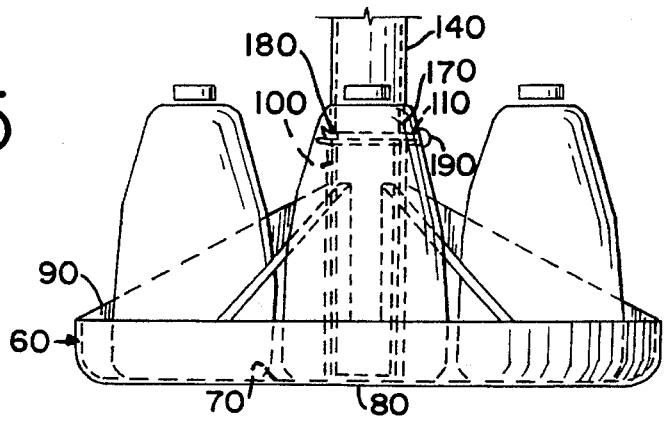
FIG. 5 is a side view showing the base of the preferred embodiment of the invention of FIG. 1.

FIG. 5 is a side elevational view of the base 60 (or identical support member 250) of the preferred embodiment of the invention 10. Base 60 has base top 70, base bottom 80, vertical dividers 90, vertical tube 100, vertical tube 100 having vertical tube edge 110. Base 60 also has base rim 120, and bulk weight 130. Also shown is first adjustment assembly 170, having first set of horizontal bores 180, in first end 150 of vertical member 140 and first pin 190.

Figure 6:
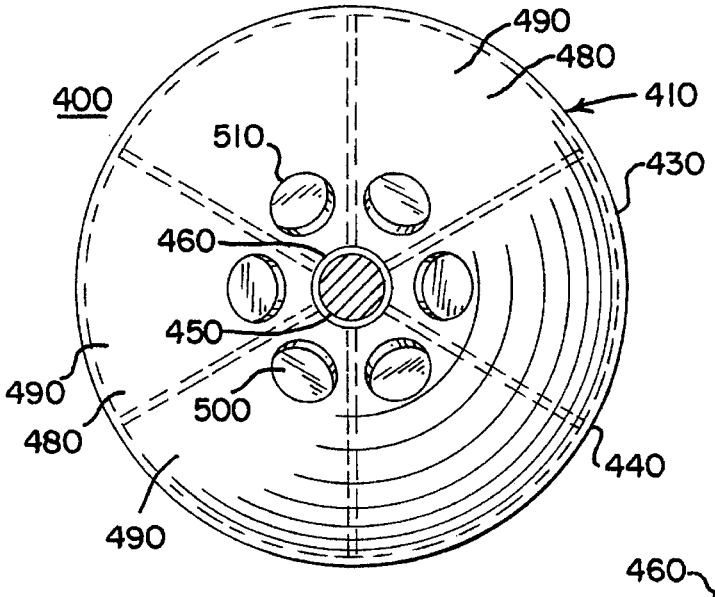
FIG. 6 is a top plan cross-sectional view showing the base of an alternate embodiment of the invention.

FIG. 6 is a top plan view of first alternate embodiment 400 of the invention 10. First alternate embodiment 400 is substantially the same as the preferred embodiment of the invention 10, except that base 410 of first alternate embodiment 400 differs from base 60 (or identical support member) of the preferred embodiment. Base 410 of first alternate embodiment 400 of the invention 10 has base top 420, base bottom 430, vertical dividers 440, and vertical tube 450. Vertical tube 450 has vertical tube edge 460. Also shown are cavities 480, having base cover members or retaining walls or cavity covers 490, accesses 500, with access closures 510. Disposed within cavities 480 is a weight (not shown). Weight can be any type of granular material which is heavier than water, such as sand, gravel, ball bearings, etc.

Figure 7:
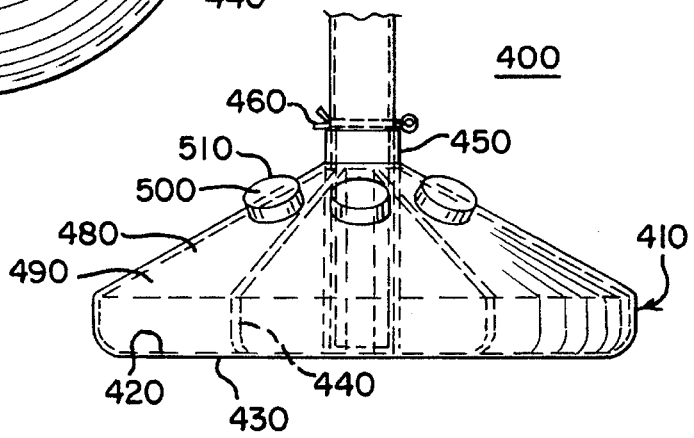
FIG. 7 is a side view showing the base of the alternate embodiment of the invention of FIG. 6.

FIG. 7 is a side elevational view of first alternate embodiment 400 of invention 10. First alternate embodiment 400 is substantially the same as the preferred embodiment of the invention 10, except that base 410 of first alternate embodiment 400 differs from base 60 of the preferred embodiment. Base 410 of first alternate embodiment 400 of the invention 10 has base top 420, base bottom 430, vertical dividers 440, and vertical tube 450. Vertical tube 450 has vertical tube edge 460. Also shown are cavities 480, having cavity covers 490, accesses 500, with access closures 510. Disposed within cavities 480 is a weight (not shown).

Figure 8:
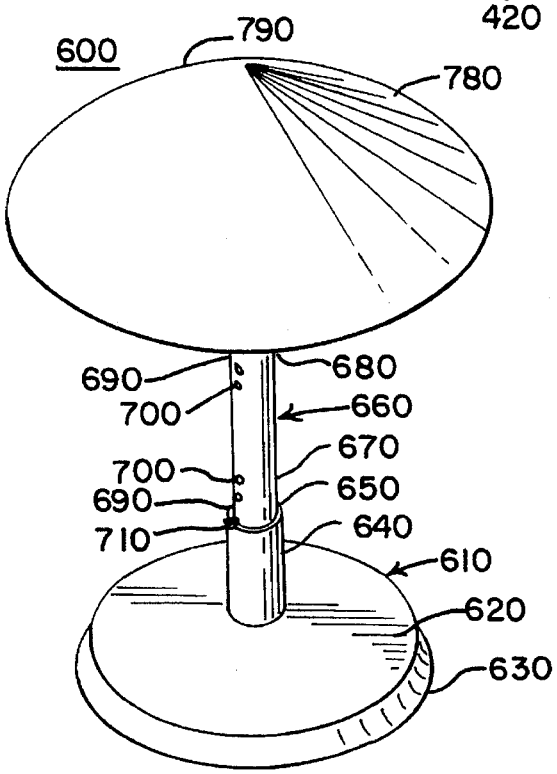
FIG. 8 is a perspective view of another alternate embodiment of the invention.

FIG. 8 shows a perspective view of a second alternate embodiment 600 of the invention 10. Second alternate embodiment 600 has base 610, with base top 620, base bottom 630, and vertical tube 640 with vertical tube edge 650. Vertical member 660, has first end 670, second end 680, adjustment assembly 690, adjustment assembly 690 having horizontal bores 700, and pin 710. Alternatively, adjustment assembly 690 could be a clamp (not shown). Second alternate embodiment 600 further has support member 780, support top 790, and support tube 820 which defines vertical member 660. Support tube 820 has support tube edge 830 (see FIG. 9).

Figure 9:
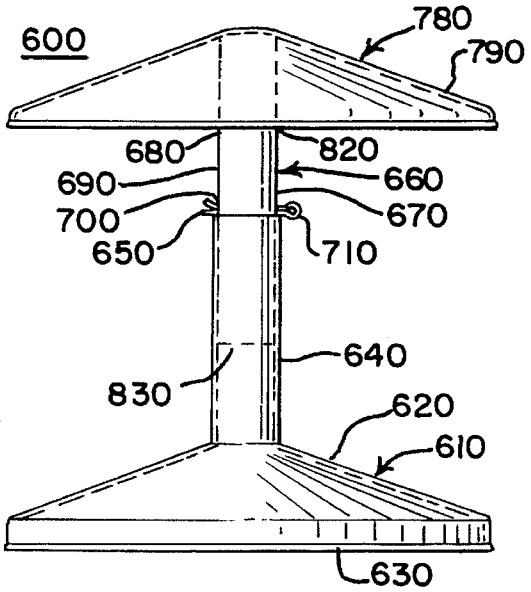
FIG. 9 is a front view of the alternate embodiment of the invention of FIG. 8.

FIG. 9 shows the a front view of the second alternate embodiment 600 of the invention 10. Second alternate embodiment 600 has base 610, with base top 620, base bottom 630, and vertical tube 640 with vertical tube edge 650. Vertical member 660, has first end 670, second end 680, adjustment assembly 690, adjustment assembly 690 having horizontal bores 700, and pin 710. Alternatively, adjustment assembly 690 could be a clamp (not shown). Second alternate embodiment 600 further has support member 780, support top 790, and support tube 820 defined as vertical member 660.

To install the invention 10, the user simply inserts first end 150 of vertical member 140 into vertical tube 100 of base 60. The user may then insert support member 250 atop the second end 160 of vertical member 140, sliding second end 160 of vertical member 140 onto support member 250 at support tube 290, as seen in FIG. 3. The weight of the vertical member 140 and the support member 250 cause first end 150 of vertical member 140 to rest on base bottom 80. The overall height of the invention 10 can then be adjusted by sliding the vertical member 140 in an upward direction, and placing first pin 190 through one of the first set of horizontal bores 180. After the first pin 190 is so inserted, the user allows the vertical member 140 to descend by weight of gravity until first pin 190 rests on vertical tube edge 110. The user may adjust the support member 250 in a similar manner, by moving the support member 250 upward, inserting second pin 230 into second set of horizontal bores 220, and allowing support member 250 to drop by gravity until support tube edge 300 of support tube 290 abuts second pin 230.

Alternately, the invention 10 may be equipped with a first clamp and second clamp 240 to adjust the height of the invention 10. The user slides the vertical member 140 in an upward direction, and placing the first clamp around vertical member 140 at the desired location thereto. The clamp is then tightened so that it is secured on the vertical member 140 by means of friction. The user allows then allows the vertical member 140 to descend by weight of gravity until the clamp rests on vertical tube edge 110. The user may adjust the support member 250 in a similar manner, by moving the support member 250 upward, inserting tightening second clamp 240 around the vertical member 140, and allowing support member 250 to drop by gravity until support tube edge 300 of support tube 290 abuts second clamp 240. The invention 10 may use a first clamp, and horizontal bores 180 with first pin 190, or horizontal bores 220 and second pin 230 with second clamp 240.

After adjusting the height of the invention 10, the user may then place the invention 10 in pool 20, either at the center or at some other desired location. In the preferred embodiment, the user then places bulk weight 130 between vertical dividers 90 as shown in FIGS. 4 and 5. The bulk weight 130 prevents the invention 10 from tipping over in the pool 20. The pool 20 can then be covered with pool cover 50, as seen in FIGS. 1 and 2.

When the pool 20 is ready for use, the user simply removes the pool cover 50, removes bulk weight 130, and lifts the invention 10 out of the water. The stand can be disassembled and stored if same is desired by the user. Because bulk weight 130 can be installed or removed from the pool 20 separately, the invention 10 can be removed or installed by persons of limited strength, such as children.

FIGS. 6 and 7 show the base of the first alternate embodiment 400 of the invention 10. Rather than using bulk weight 130, cavities 480 are filled with a weight, such as sand or gravel. The height of first alternate embodiment 480 is adjusted as in the preferred embodiment of the invention 10. The first alternate embodiment 480 is simply placed in the pool 20 by the user, and removed prior to use of the pool 20.

FIGS. 8 and 9 show the second alternate embodiment 600 of the invention 10. The height of second alternate embodiment 600 is adjusted as in the preferred embodiment of the invention 10. The first alternate embodiment 600 is simply placed in the pool 20 by the user, and removed prior to use of the pool 20.

The foregoing specification describes only the preferred embodiment and the alternate embodiments of the invention as shown. Other embodiments may be articulated as well. The terms and expressions therefore serve only to describe the invention by example only and not to limit the invention. It is expected that others will perceive differences which while differing from the foregoing, do not depart from the spirit and scope of the invention herein described and claimed.

I claim:

1. A free-standing device for supporting a cover for a swimming pool having a bottom surface and sidewalls, comprising:

a base member having a bottom panel for engaging the bottom surface of the pool, a center support extending from said bottom panel, and a plurality of dividers extending from said center support and forming interstices between adjacent dividers;

an elongate member having first and second ends, said first end of said elongate member cooperatively associated with said center support;

a cover support member disposed on said second end of said elongate member at a distance from said base member; and at least one removable weight means, disposed in a respective one of said interstices, for biasing said base member against the bottom surface of said swimming pool in a central position, said at least one removable weight means preventing said base member from movement relative to said bottom surface from said central position during use of said device and allowing said device to be free-standing in said central position independent from said sidewalls;

wherein said center support of said base member is tubular and wherein said base member is generally circular in configuration and said dividers extend radially from said center support;

wherein said base member comprises a circumferential rim extending substantially perpendicular to said bottom panel and wherein each of said dividers is attached to said rim;

wherein said base member is of a single-piece, homogenous construction;

wherein said cover support member is provided with a curved circumferential edge for preventing damage to said cover; and wherein said base member and said cover support member are structurally identical to each other.

2. A free-standing device for supporting a cover for a swimming pool having a bottom surface and sidewalls, comprising:

a base member having a bottom panel for engaging the bottom surface of the pool, a center support extending from said bottom panel, and a plurality of dividers extending from said center support and forming interstices between adjacent dividers;

an elongate member having first and second ends, said first end of said elongate member cooperatively associated with said center support;

a cover support member disposed on said second end of said elongate member at a distance from said base member; and at least one removable weight means, disposed in a respective one of said interstices, for biasing said base member against the bottom surface of said swimming pool in a central position, said at least one removable weight means preventing said base member from movement relative to said bottom surface from said central position during use of said device and allowing said device to be free-standing in said central position independent from said sidewalls;

wherein said base member and said cover support member are structurally identical;

wherein said at least one removable weight means comprises a plastic container filled with granular material and configured to fit within a respective one of said interstices; and wherein each of said plastic containers is provided with a handle.

* * * * *